US011583994B2

(12) United States Patent
Hsieh

(10) Patent No.: US 11,583,994 B2
(45) Date of Patent: Feb. 21, 2023

(54) DUSTPROOF STRUCTURE OF HAND TOOL

(71) Applicant: KABO Tool Company, Taichung (TW)

(72) Inventor: Chih-Ching Hsieh, Taichung (TW)

(73) Assignee: KABO Tool Company, Taichung (TW)

( * ) Notice: Subject to any disclaimer, the term of this patent is extended or adjusted under 35 U.S.C. 154(b) by 163 days.

(21) Appl. No.: 17/303,034

(22) Filed: May 19, 2021

(65) Prior Publication Data

US 2021/0362318 A1 Nov. 25, 2021

(30) Foreign Application Priority Data

May 20, 2020 (TW) ..... 109116731

(51) Int. Cl.

| | |
|---|---|
| ***B25G 1/02*** | (2006.01) |
| ***B25B 23/16*** | (2006.01) |
| ***B25B 13/46*** | (2006.01) |
| ***B25B 23/142*** | (2006.01) |

(52) U.S. Cl.

CPC ..... *B25G 1/025* (2013.01); *B25B 23/16* (2013.01); *B25B 13/463* (2013.01); *B25B 23/1427* (2013.01)

(58) Field of Classification Search

CPC ..... B25G 1/025; B25B 23/16; B25B 23/1427; B25B 13/463

See application file for complete search history.

(56) References Cited

U.S. PATENT DOCUMENTS

| | | | | |
|---|---|---|---|---|
| 6,978,705 | B1 * | 12/2005 | Lee | B25B 23/1427 81/468 |
| 2018/0141193 | A1 * | 5/2018 | Chen | B25B 23/1427 |
| 2020/0030950 | A1 * | 1/2020 | Chen | B25B 23/1427 |

* cited by examiner

*Primary Examiner* — David B. Thomas

(74) *Attorney, Agent, or Firm* — Wang Law Firm, Inc.

(57) ABSTRACT

A dustproof structure of a hand tool includes a tool body and a dustproof element. The tool body has a shank. A predetermined portion of the shank is concavely provided with a through hole. The dustproof element is flexible, is provided at the through hole of the shank, and can be opened and closed. The dustproof element closes the through hole when not subjected to an applied force and is elastically deformed to render the through hole into an open state when subjected to the applied force. In normal conditions, therefore, the dustproof element can block foreign matter from entering the through hole. When it is desired to perform a lubricating or adjusting operation on a component in the through hole of the hand tool, the operation can be carried out after directly applying a force to, and thus deforming, the dustproof portion, without having the dustproof element removed.

11 Claims, 8 Drawing Sheets

DUSTPROOF STRUCTURE OF HAND TOOL

BACKGROUND OF THE INVENTION

1. Technical Field

The present invention relates to a hand tool and more particularly to a dustproof structure of a hand tool, wherein the dustproof structure not only prevents dust from entering the hand tool, but also allows access to the internal components of the hand tool without having to remove any component of the dustproof structure.

2. Description of Related Art

Referring to FIG. 1, a conventional hand tool 10 is provided therein with an operation unit 11. The operation unit 11 may be configured to carry out torque adjustment, to drive another component of the hand tool 10, or to perform other functions. Depending on practical needs, it may be required to adjust the operation unit 11 with a tool from the outside (for torque adjustment for example) or inject oil into the hand tool 10 for lubrication purposes. If the operation unit 11 is exposed from the hand tool 10, it is very likely that the operation unit 11 will come into contact with dust in the external environment while the hand tool 10 is in use. The dust will eventually fall into the hand tool 10 and thus compromise the operation of the operation unit 11. Or, the dust having entered the hand tool 10 will cause wear of the operation unit 11 such that the operation precision of the hand tool 10 is lowered.

To prevent contact between the operation unit 11 and the external environment, a dustproof plug 12 is generally provided on the outer side of the operation unit 11 to isolate the operation unit 11 from the external environment. When it is desired to fine-tune or perform maintenance work on the operation unit 11, the dustproof plug 12 must be removed, and once the fine-tuning operation or maintenance work is completed, the dustproof plug 12 is put back in place. In terms of use, both the removal and the reinstallation of the dustproof plug 12 require a special tool, for the dustproof plug 12 must be tight enough to provide the intended blockage. If that special tool cannot be found when needed, the dustproof plug 12 cannot be removed or may be damaged when improperly removed. Moreover, if the dustproof plug 12 is not put at a fixed location when removed, it may get lost when the maintenance work or fine-tuning operation is completed. Should the dustproof plug 12 be lost, so will the protection it provides for the operation unit 11.

BRIEF SUMMARY OF THE INVENTION

The primary objective of the present invention is to provide a dustproof structure that not only can prevent dust from entering a hand tool, but also allows the internal structure of the hand tool to be lubricated or adjusted without having to remove any component of the dustproof structure.

To achieve the above objective, the present invention provides a dustproof structure of a hand tool, wherein the dustproof structure includes a tool body and a dustproof element.

The tool body has a shank. The front end of the shank has a working head. A predetermined portion of the shank is concavely provided with a through hole. An operation unit is provided in the shank, and the through hole is configured to provide access to the operation unit.

The dustproof element is flexible, is provided at a through hole of a tool, and can be opened and closed. The dustproof element closes the through hole when not subjected to an applied force. Once subjected to the applied force, however, the dustproof element is elastically deformed and thereby renders the through hole into an open state.

Preferably, the dustproof element includes a connecting portion, and the connecting portion can be provided in the through hole.

Preferably, the dustproof element further includes a plurality of bristles distributed over a predetermined area of the connecting portion.

Preferably, the dustproof element is formed with at least one flexible dustproof plate, and the at least one dustproof plate covers an end face of the through hole.

The disclosed dustproof structure of a hand tool is so designed that the dustproof element can block out foreign matter during normal operation, and that when it is desired to adjust or lubricate the internal structure of the hand tool, a force can be directly applied to the dustproof element by the adjustment or lubrication tool in order to deform the dustproof element, thereby allowing the adjustment or lubrication tool to extend into the through hole without having to remove the dustproof element with a dedicated tool. Thus, the difficulty of performing maintenance work on and adjusting the internal structure of the hand tool is lowered.

BRIEF DESCRIPTION OF THE SEVERAL VIEWS OF THE DRAWINGS

In order for the examiner to better understand the objectives, features, and intended effects of the present invention, four preferred embodiments of the invention are detailed below with reference to the accompanying drawings, in which.

DETAILED DESCRIPTION OF THE INVENTION

Figure 1:
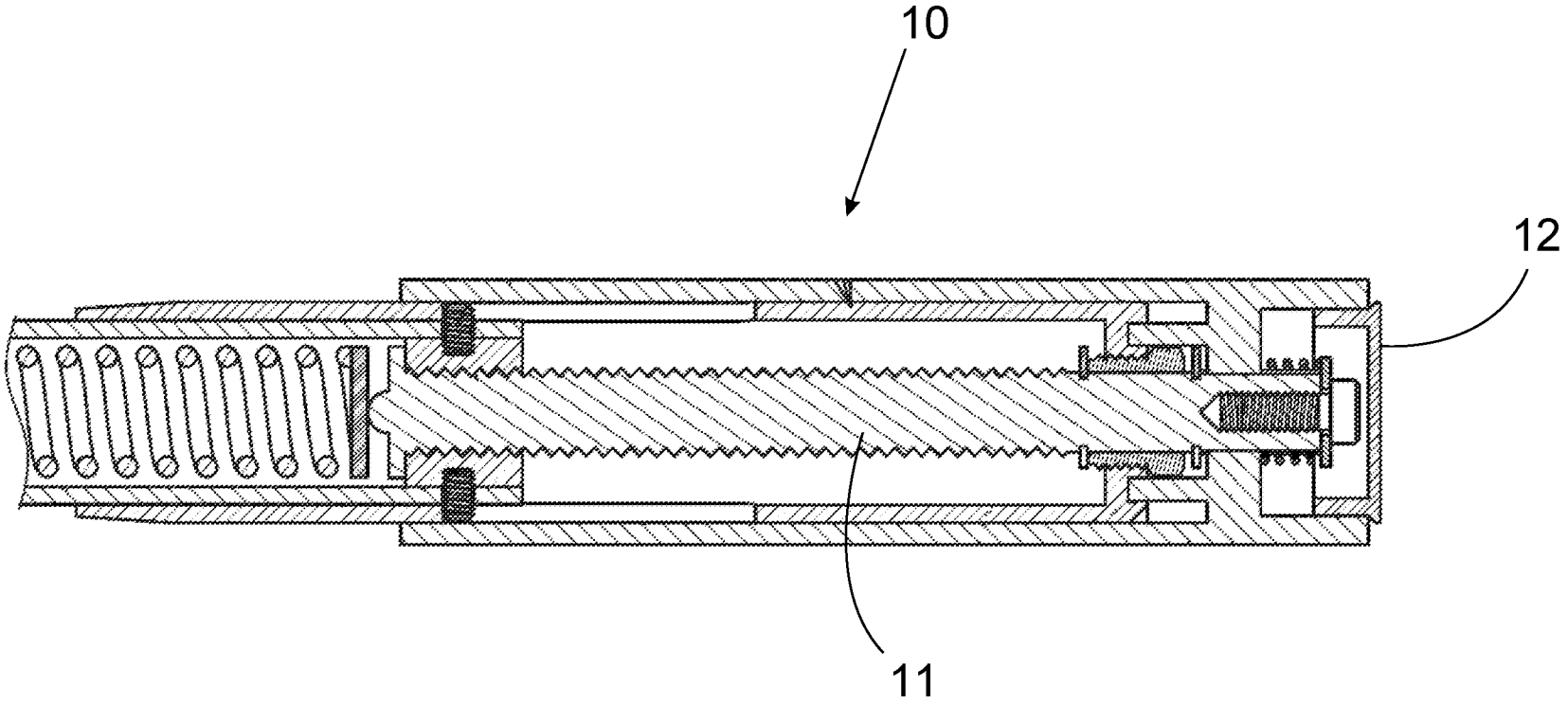
FIG. 1 is a partial assembled sectional view of a convention hand tool with a dustproof plug.
Figure 2:
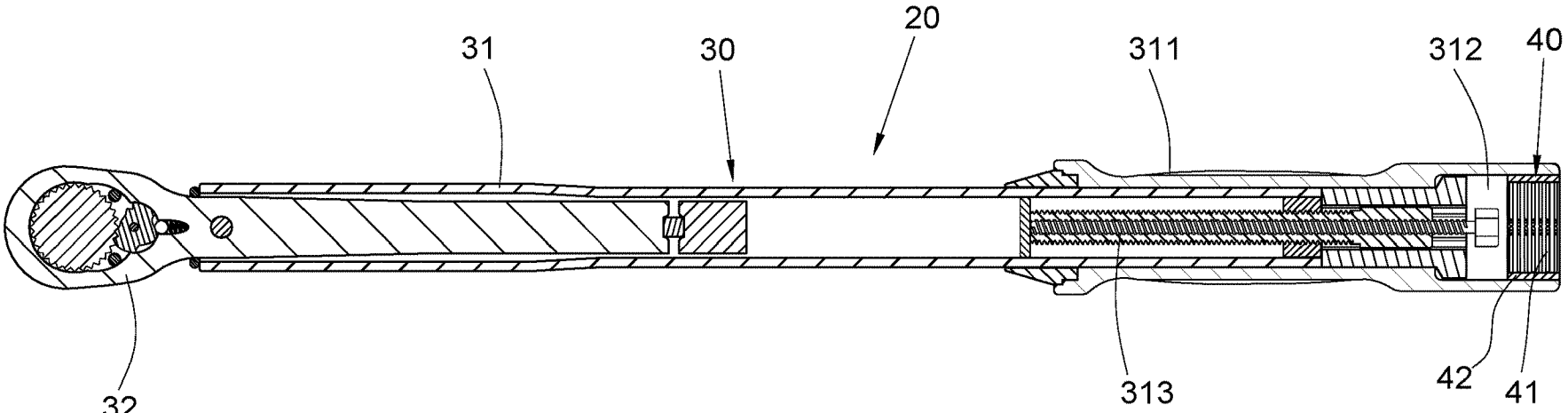
FIG. 2 is an assembled sectional view of the hand tool according to a preferred embodiment of the invention, wherein the hand tool has a dustproof element.
Figure 3:
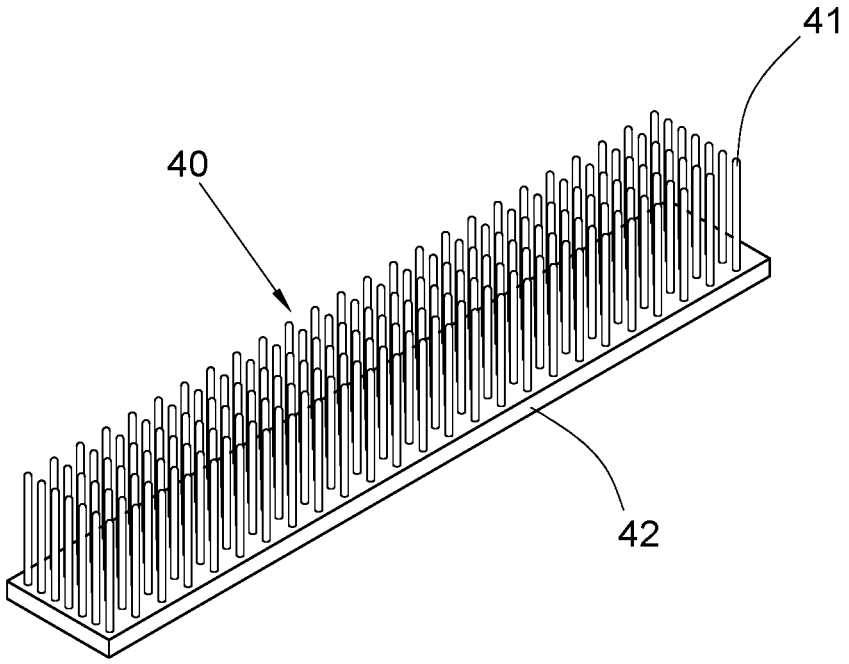
FIG. 3 is a perspective view of the dustproof element in FIG. 2, showing the bristles and the connecting portion of the dustproof element in an extended state and not yet mounted in a through hole of the hand tool.
Figure 4:
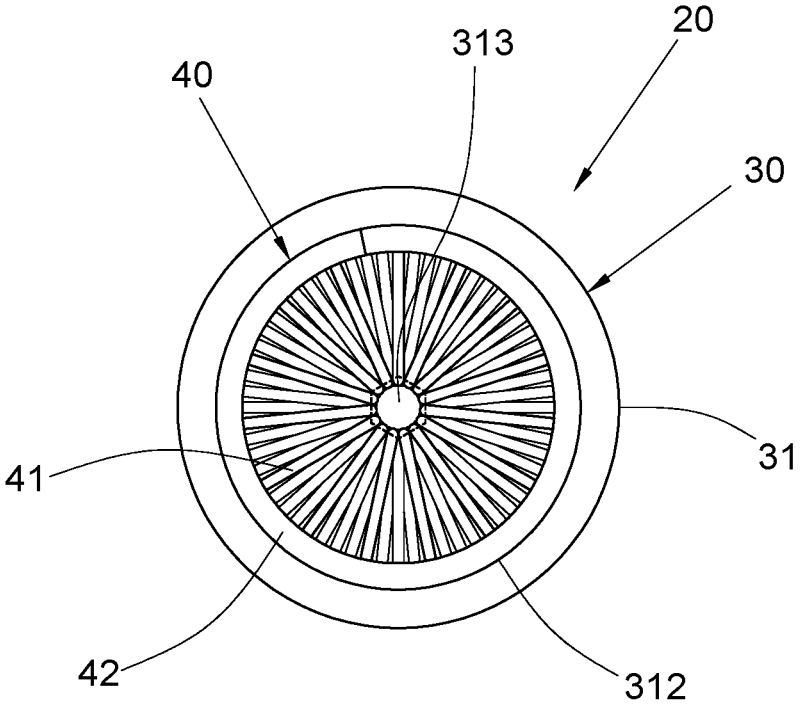
FIG. 4 is a sectional view of the dustproof element in FIG. 3 mounted in the through hole of the hand tool.

Referring to FIG. 2 to FIG. 4 for the hand tool 20 provided in a preferred embodiment of the present invention, the hand tool 20 includes a tool body 30 and a dustproof element 40.

The tool body 30 has a shank 31 and a working head 32. The front end of the shank 31 is connected to the working head 32. The rear end of the shank 31 forms a gripping portion 311. The rear end face of the gripping portion 311 of the shank 31 is concavely provided with a through hole 312. The shank 31 is provided therein with an operation unit 313. In this embodiment, the operation unit 313 is a threaded rod whose working length can be adjusted to adjust the torque to be applied by the working head 32. The operation unit 313, however, is not limited to a threaded rod. The through hole 312 is configured to provide access to the operation unit 313. The working head 32 is configured to apply a torque whose moment arm is defined by the shank 31. In this embodiment, the working head 32 is a ratchet head by way of example only. The working head 32 is a structure well known in the art and therefore will not be described in more detail herein.

Figure 6:
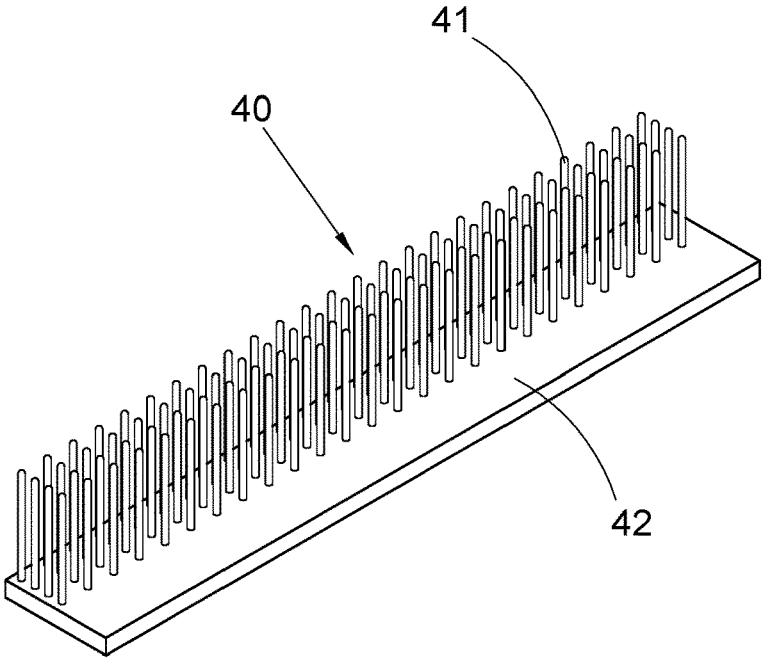
FIG. 6 is similar to FIG. 3 except that the bristles are distributed over only a partial surface area of the connecting portion.

The dustproof element 40 in this embodiment is composed of a plurality of bristles 41 and a plate-shaped connecting portion 42. The bristles 41 are flexible and can deform when subjected to an applied force. The bristles 41 are provided on the surface of one side of the plate-shaped connecting portion 42. As shown in FIG. 3 and FIG. 6, the bristles 41 may be provided on the upper or lower half of the surface of one side of the connecting portion 42 or be distributed over the entirety of the surface of one side of the connecting portion 42. The plate-shaped connecting portion 42 can be curled into a tubular shape such that the bristles 41 are located on the inner periphery of the plate-shaped (now tubular) connecting portion 42.

Figure 5:
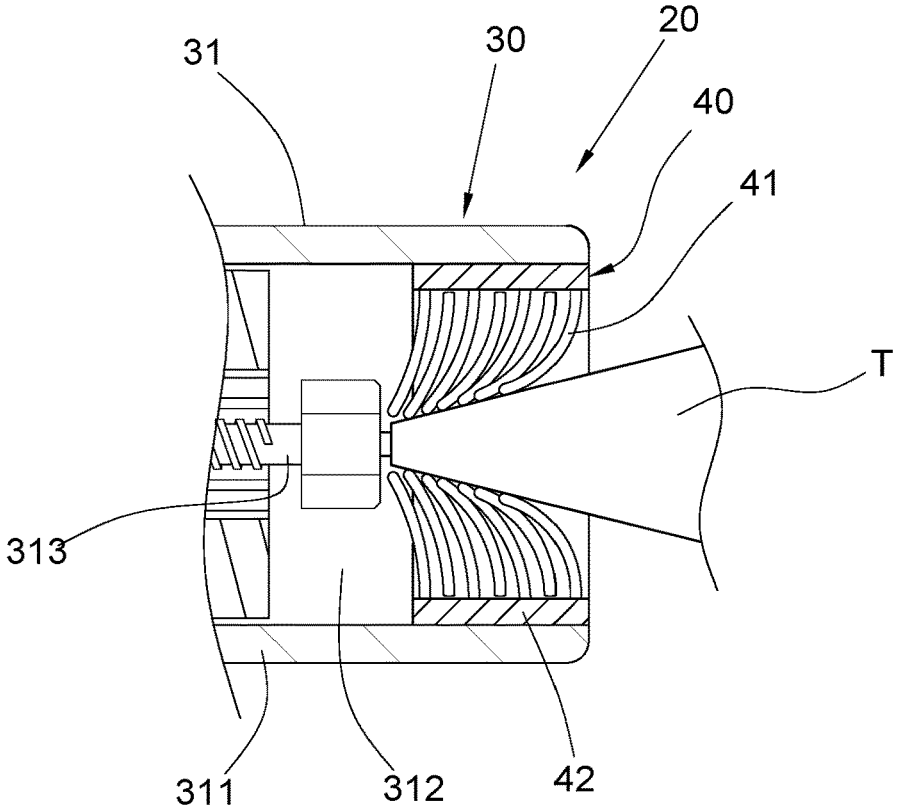
FIG. 5 is a sectional view showing the dustproof element in FIG. 4 subjected to, and thus deformed by, an applied force.

To use the tool body 30, referring to FIG. 2, the user holds the gripping portion 311 of the shank 31 and rotates, and thereby applies a force to, the working head 32 in order for the working head 32 to tighten or loosen the fastener engaged therewith. During normal operation or when the hand tool 20 is put away, the bristles 41 of the dustproof element 40 are not subjected to any applied force and are therefore erect. The bristles 41 in this state close the through hole 312 to prevent dust and debris from entering the through hole 312, thereby keeping the operation unit 313 in the shank 31 clean. When it is desired to adjust the operation unit 313, referring to FIG. 5, an adjustment tool T can be inserted into the end face of the through hole 312. As the bristles 41 of the dustproof element 40 are located in the through hole 312, the adjustment tool T applies a pushing force to, and thus deforms, the bristles 41 such that the through hole 312 is rendered into an open state and will not hinder the adjustment tool T from adjusting the operation unit 313. When the adjusting operation is completed, the adjustment tool T is pulled out of the through hole 312, and once the force applied by the adjustment tool T to the bristles 41 is removed, the bristles 41 resume their erect state and close the through hole 312 again.

Figure 7:
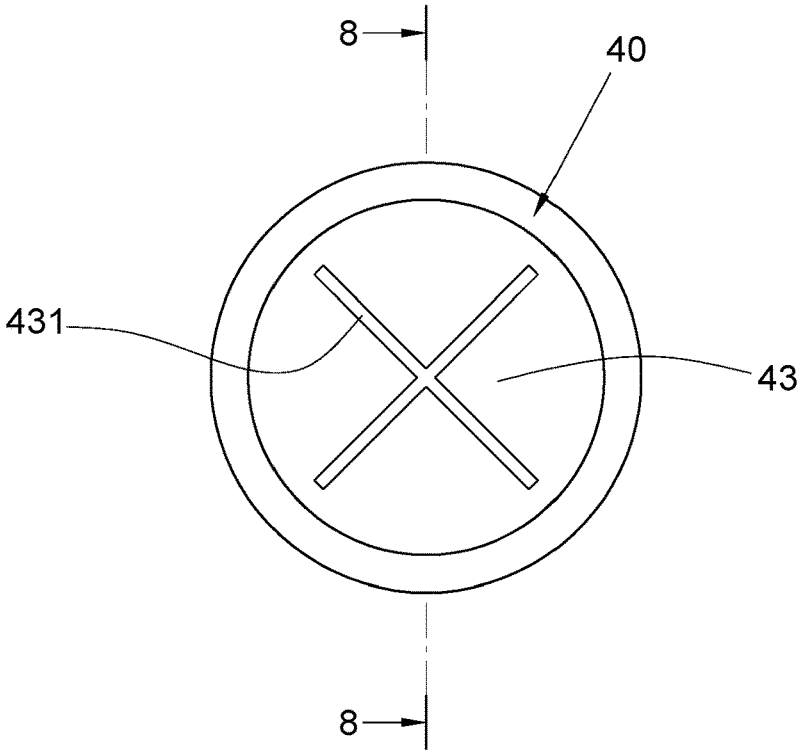
FIG. 7 is a side view of the dustproof element in another preferred embodiment of the invention, wherein the dustproof element includes four dustproof plates.
Figure 8A:
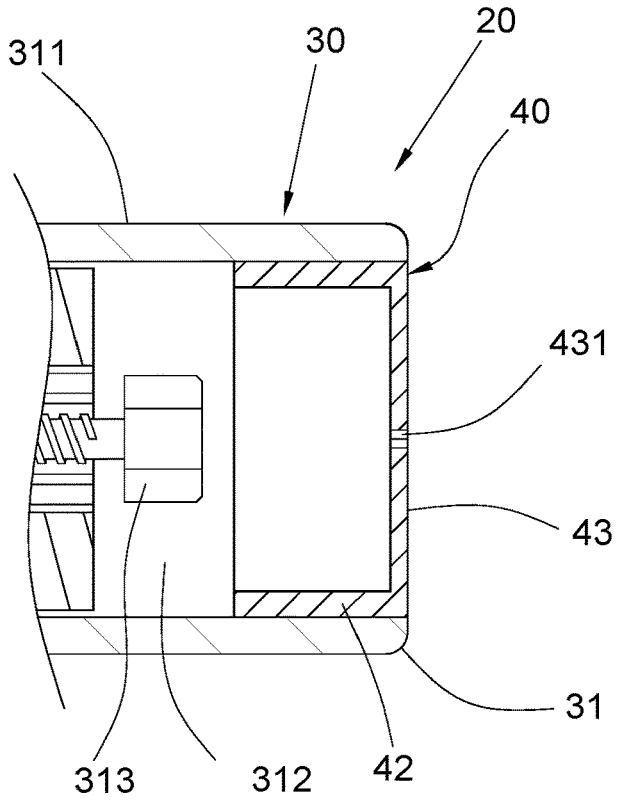
FIG. 8(A) is a sectional view taken along line 8-8 in FIG. 7, showing the dustproof plates mounted in the through hole of the hand tool.
Figure 8B:
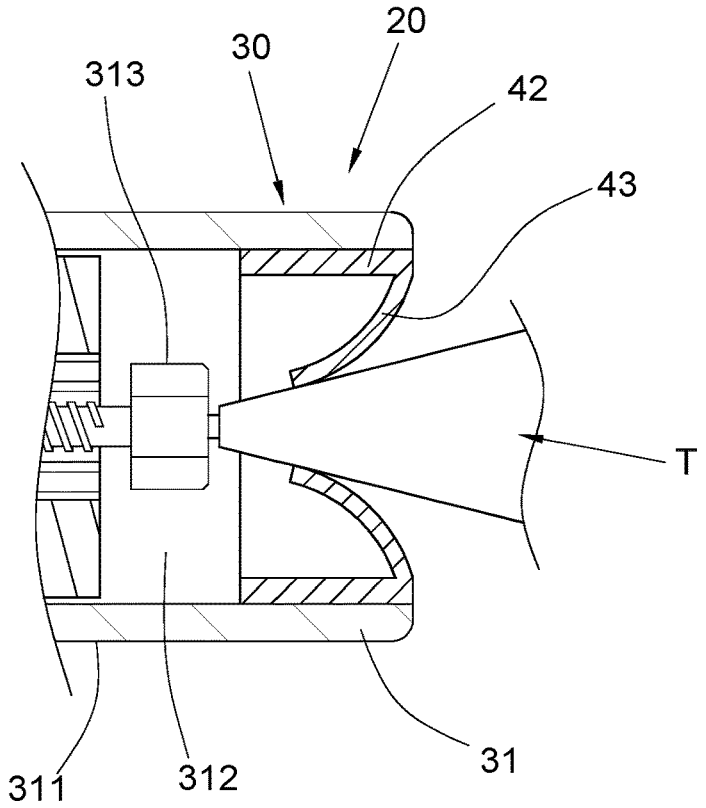
FIG. 8(B) is similar to FIG. 8(A) except that the dustproof plates are subjected to, and thus bent further into the through hole, by the force applied by an adjustment tool.

Referring to FIG. 7 and FIG. 8 for the second preferred embodiment of the present invention, the main structure of the second preferred embodiment is the same as that of the previous embodiment, and identical elements in the two embodiments are indicated by the same reference numeral and will not be described repeatedly.

The dustproof element 40 in the second preferred embodiment has a tubular connecting portion 42 and four flexible dustproof plates 43. The dustproof plates 43 are provided at the outer end face of the connecting portion 42 and are spaced apart by gaps 431 formed between the dustproof plates 43. When the dustproof plates 43 are not subjected to any applied force, the end face of the through hole 312 is covered by the dustproof plates 43, and the combined area of the dustproof plates 43 is equivalent to the cross-sectional area of the through hole 312 such that the end face of the through hole 312 is closed by the dustproof plates 43 except at positions corresponding to the gaps 431 between the dustproof plates 43. The dustproof plates 43, therefore, can block external dust and dirt from entering the through hole 312 when not subjected to any applied force. When the adjustment tool T is inserted into the through hole 312, the adjustment tool T applies a force to, and thus elastically deforms, the dustproof plates 43. As a result, the dustproof plates 43 are curved into the through hole 312, and the gaps 431 between the dustproof plates 43 are widened, thereby allowing the adjustment tool T to enter the through hole 312 and perform an adjusting operation on the operation unit 313. Once the adjusting operation is completed, the adjustment tool T is pulled out of the through hole 312, and the dustproof plates 43 close the end face of the through hole 312 again by returning to the state in which the dustproof plates 43 are subjected to no applied force.

Figure 11:
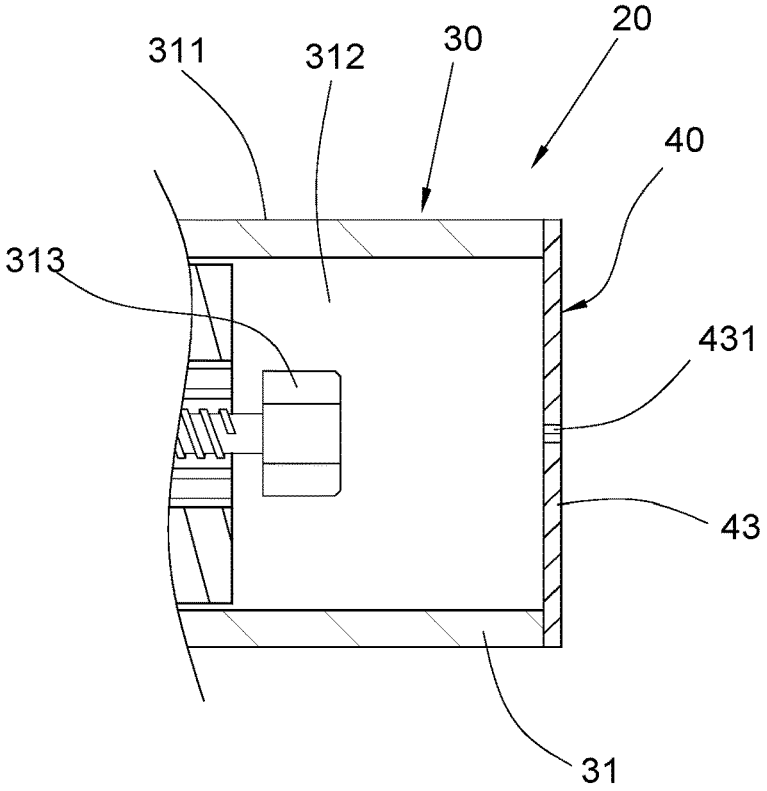
FIG. 11 is a sectional view of a variant of the dustproof element in FIG. 7 to FIG. 8(B), showing the dustproof element directly adhered to an end of a gripping portion of the hand tool.
Figure 12:
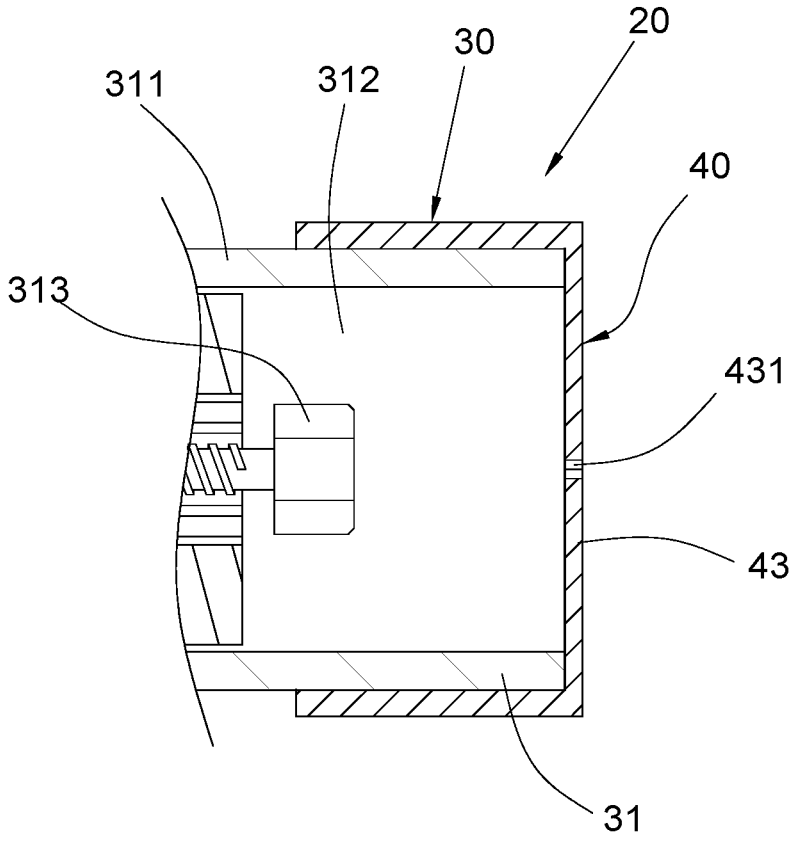
FIG. 12 is a sectional view of another variant of the dustproof element in FIG. 7 to FIG. 8(B), showing the connecting portion of the dustproof element surrounding the outer periphery of an end portion of the gripping portion.

In practice, referring to FIG. 11 and FIG. 12, the dustproof plates 43 of the dustproof element 40 may dispense with the connecting portion 42, provided that the dustproof plates 43 can cover the end face of the through hole 312 and block the through hole 312 from contact with the external environment. As shown in FIG. 12, the connecting portion 42 may also be provided outside the through hole 312, e.g., mounted around and fixed to the outer periphery of a rear end portion of the gripping portion 311.

Figure 9:
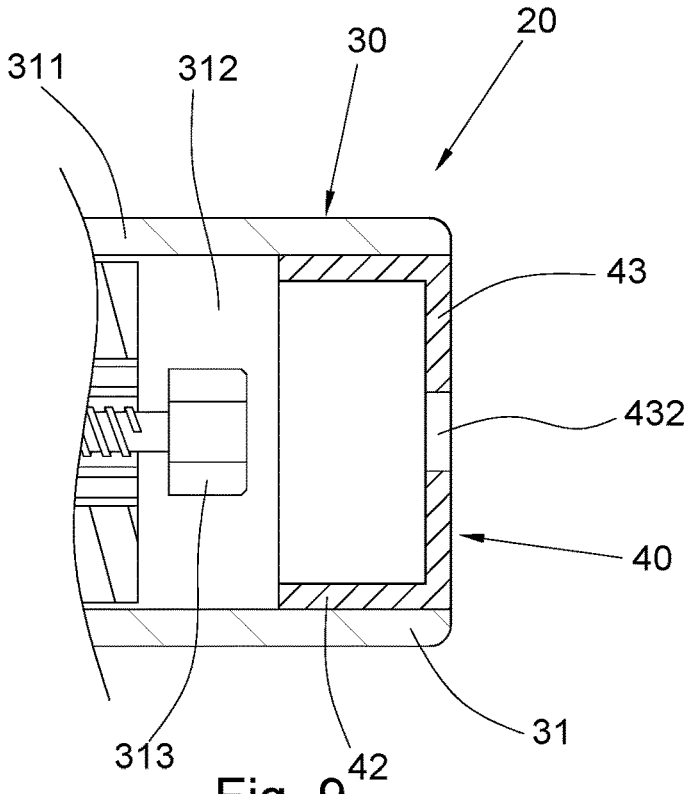
FIG. 9 is a sectional view of the dustproof element in yet another preferred embodiment of the invention, wherein the dustproof element includes a single dustproof plate.
Figure 10:
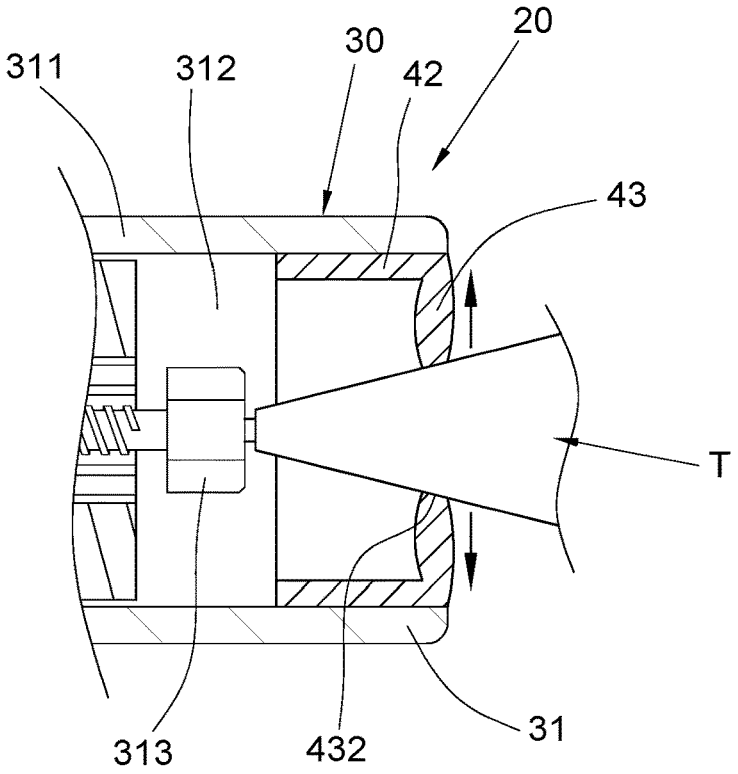
FIG. 10 is similar to FIG. 9 except that the dustproof plate is subjected to, and thus deformed by, an applied force.

Referring to FIG. 9 and FIG. 10 for the third preferred embodiment of the present invention, the main structure of the third preferred embodiment is the same as that of the previous embodiment, and identical elements in the two embodiments are indicated by the same reference numeral and will not be described repeatedly.

The dustproof element 40 in the third preferred embodiment has a tubular connecting portion 42 and a flexible dustproof plate 43. The dustproof plate 43 is provided at the outer end face of the connecting portion 42 and has a guide hole 432 at the center. When the dustproof plate 43 is not subjected to any applied force, the diameter of the guide hole 432 is smaller than that of the cross-sectional area of the through hole 312 such that the through hole 312 is in a closed state except at the tiny aperture formed by the guide hole 432. The dustproof plate 43, therefore, can block external dust and dirt from entering the through hole 312 when not subjected to any applied force. When the adjustment tool T is inserted into the through hole 312, the adjustment tool T applies a force to the dustproof plate 43 and thus deforms the guide hole 432 of the dustproof plate 43. As a result, the diameter of the guide hole 432 is increased and becomes equivalent to that of the through hole 312, thereby allowing the adjustment tool T to enter the through hole 312 and perform an adjusting operation on the operation unit 313. Once the adjusting operation is completed, the adjustment tool T is pulled out of the through hole 312, and the end face of the through hole 312 is closed again as the guide hole 432 of the dustproof plate 43 returns to the state in which it is subjected to no applied force.

The dustproof element provided by the present invention can effectively prevent dust and other foreign matter from entering the through hole from the outside when not subjected to an applied force, and allows access to the operation unit in the through hole without having to be removed. Compared with the conventional dustproof structures whose dustproof plug must be removed in order to provide access to the operation unit inside, the invention is indeed capable of lowering the difficulty of operation and maintenance and enhancing operation efficiency.

The embodiments described above serve only to explain the technical means of the present invention but not to limit the scope of the invention. Any equivalent modification based on the concept of the invention shall fall within the scope of patent protection of the invention. The dustproof element in the invention is the first of its kind in the art and provides an improvement in functionality, so a patent application for the invention is hereby filed according to the law.

What is claimed is:

1. A dustproof structure of a hand tool, comprising:

a tool body having a shank, wherein the shank has a front end having a working head, the shank has a predetermined portion concavely provided with a through hole, the shank is provided therein with an operation unit, and the through hole is configured to provide access to the operation unit; and a dustproof element having flexibility, provided at the through hole of the shank, and configured to be opened and closed, wherein the dustproof element closes the through hole when not subjected to an applied force and is elastically deformed to render the through hole into an open state when subjected to the applied force.

2. The dustproof structure of claim 1, wherein the dustproof element comprises a connecting portion, and the connecting portion is provided in the through hole.

3. The dustproof structure of claim 2, wherein the connecting portion is plate-shaped, and the dustproof element further comprises a plurality of bristles distributed over a predetermined area of the connecting portion.

4. The dustproof structure of claim 3, wherein the connecting portion has a region adjacent to an end face of the through hole, and the bristles are provided on the region of the connecting portion.

5. The dustproof structure of claim 3, wherein the connecting portion has a region adjacent to the operation unit, and the bristles are provided on the region of the connecting portion.

6. The dustproof structure of claim 2, wherein the connecting portion is a hollow tube with a central through hole, and the dustproof element is provided at an end face of the connecting portion.

7. The dustproof structure of claim 6, wherein the dustproof element is formed with at least one flexible dustproof plate, and the at least one dustproof plate covers an end face of the through hole.

8. The dustproof structure of claim 7, wherein there are a plurality of said dustproof plates, a plurality of gaps are formed between the dustproof plates, and each said dustproof plate is bendable when subjected to the applied force.

9. The dustproof structure of claim 7, wherein the dustproof plate is centrally formed with a guide hole, and the guide hole is variable in diameter when subjected to the applied force.

10. The dustproof structure of claim 1, wherein the front end of the shank is provided with the working head, the shank has a rear end having a gripping portion, and the through hole is provided at an end of the gripping portion.

11. The dustproof structure of claim 1, wherein the dustproof element is formed with at least one flexible dustproof plate, and the at least one dustproof plate covers an end face of the through hole.

* * * * *